United States Patent [19]

Bach et al.

[11] Patent Number: 4,589,702

[45] Date of Patent: May 20, 1986

[54] WHEEL, IN PARTICULAR FOR A TOY BUILDING SET

[75] Inventors: Erik Bach; Erling T. Dideriksen, both of Billund, Denmark

[73] Assignee: Interlego A.G., Baar, Switzerland

[21] Appl. No.: 618,459

[22] Filed: Jun. 8, 1984

[30] Foreign Application Priority Data

Jun. 9, 1983 [DK] Denmark ..... 2633/83

[51] Int. Cl.[4] ..... B60B 5/02

[52] U.S. Cl. ..... 301/63 PW; 301/5.3; 301/111

[58] Field of Search ..... 301/63 PW, 111, 112, 301/1, 5.3, 5.7, 119, 122; 446/431, 448, 465, 469

[56] References Cited

U.S. PATENT DOCUMENTS

| | | | |
|---|---|---|---|
| 2,741,323 | 4/1956 | Senkowski et al. | 301/126 X |
| 2,978,277 | 4/1961 | Gaudry | 301/111 |
| 3,107,947 | 10/1963 | Hulterstrum | 301/1 X |
| 3,360,314 | 12/1967 | Loreto | 301/5.7 |
| 3,454,305 | 7/1969 | Gilmour, Jr. | 301/1 |
| 3,566,536 | 3/1971 | Baynes et al. | 301/1 |
| 3,608,236 | 9/1971 | Beny et al. | 301/1 X |
| 3,638,352 | 2/1972 | Christiansen | 301/112 X |
| 3,638,356 | 2/1972 | La Branche | 301/1 X |
| 4,114,952 | 9/1978 | Kimmell | 301/63 PW |
| 4,361,980 | 12/1982 | Chatani | 301/63 PW |

*Primary Examiner*—David A. Scherbel
*Assistant Examiner*—Russell D. Stormer
*Attorney, Agent, or Firm*—Kane, Dalsimer, Kane, Sullivan and Kurucz

[57] ABSTRACT

A wheel is partly closed at one side by a hub cap (1) continuous with the rim (6) and is designed to receive an axle from the opposite side. According to the invention, the hub of the wheel consists of a plurality of ribs (14–17) which serve as bearing faces for the axle and whose geometric, axial elongations clear a plurality of spokes (2–5) forming the connection of the hub cap to the rim (6). This enables injection moulding in one operation with the simultaneous provision of an inside cavity behind the hub cap to receive a radially resilient and projecting bead (11) at the end of the axle.

5 Claims, 8 Drawing Figures

Figure 4:
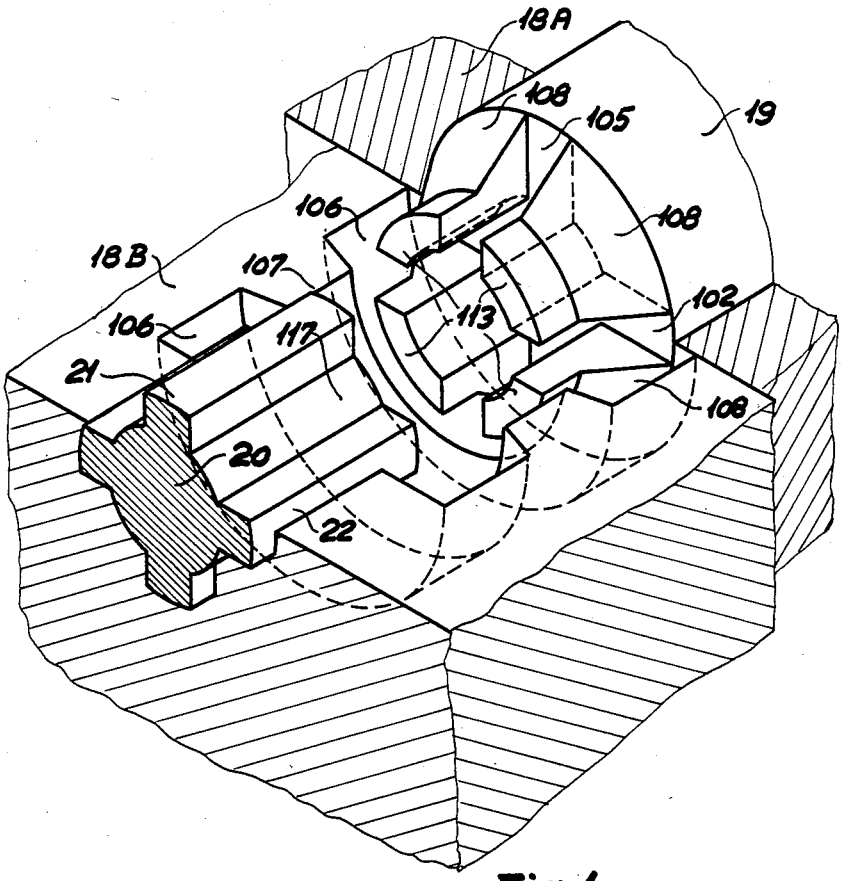

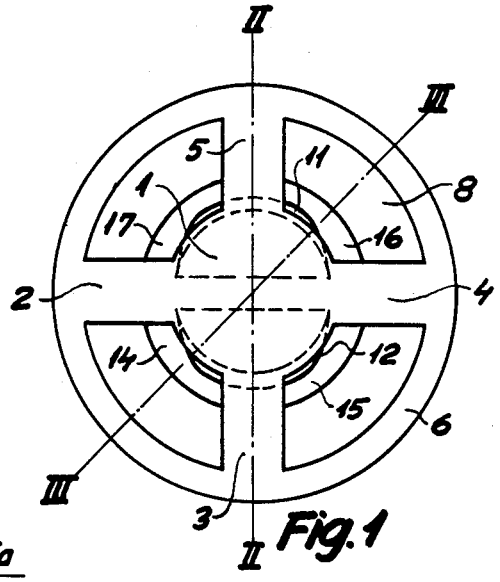
Fig.1
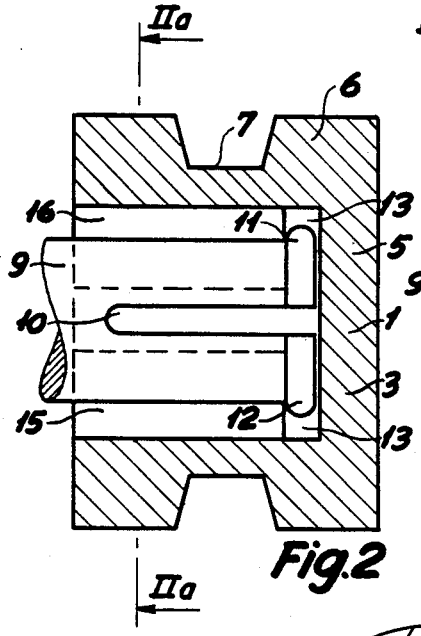
Fig.2
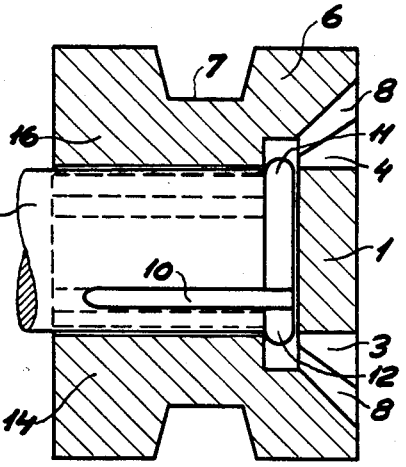
Fig.3
Fig.2a
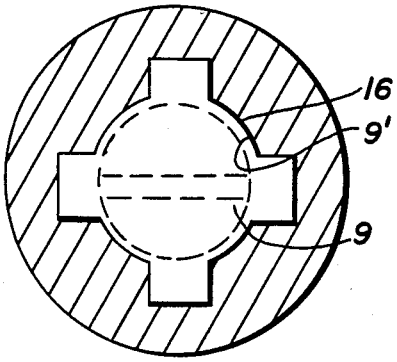

WHEEL, IN PARTICULAR FOR A TOY BUILDING SET

The invention relates to a wheel, in particular for a toy building set, and with a hub comprising a plurality of spaced axial ribs. Such a wheel may e.g. have four ribs fitting snugly around an axle of cruciform cross-section.

In the event that the wheel is to rotate freely on an axle secured against rotation, which may be the case with driving wheels for a model of car, the wheel must not fit snugly around the axle, and therefore the problem arises of how to fix the wheel axially with respect to the axle. This can be solved in a simple manner by means of an annular, radially projecting bead at the end of the axle in connection with slitting of the axle end so that the bead may yield while being passed through the wheel and then snap out as a snap lock.

However, it is desirable that wheels, in particular for car models, must look as authentic as possible, which involves the wish for making the wheel with a hub cap. Owing to the mentioned snap lock effect it would then be necessary to have a region behind the hub cap, co-axial with the axle and of greater diameter than the bearing face diameter, but this makes the construction of the wheel so complicated that it cannot be injection-moulded in a single operation and cannot therefore be manufactured sufficiently inexpensively.

The object of the invention is to provide a wheel of the stated type and of such a structure that the wheel can be manufactured in a single injection moulding operation and has, when moulded. a region of greater diameter than the bearing face diameter behind the hub cap.

This object is achieved in that the rib faces directed toward the axis of the hub are designed to serve as bearing faces for an axle, and that the wheel comprises a hub cap which is connected to the wheel at an axial distance from the ribs and which nowhere overlaps the axial elongation of the ribs within a region co-axial with the axis and of greater diameter than the bearing face diameter. The hub cap thus has the form of a disc whose diameter does not exceed the bearing face diameter and which is connected to the hub through spokes axially aligned with spaces between the ribs. As will appear from the subsequent description, precisely these conditions allow the provision of a reasonably simple tool for injection moulding the wheel in a single operation.

The tool can be simplified the most when the hub cap is axially aligned with a cavity defined within and between the ribs. Preferably, the part, disposed between the ribs and the hub cap, of the mentioned region co-axial with the axis is ring-shaped to receive a bead at the end of a wheel axle.

It will be appreciated that uses may also occur where positive engagement between a drive shaft and the wheel is desired. This can be obtained when the hub cap has a recess which is open in a direction toward the hub and is designed to receive a splined shaft with a plurality of projections disposed between the splines so that a plurality of the projections is disposed in alignment with the hub ribs; the splined shaft may typically be a so-called cruciform shaft whose greatest outside diameter corresponds to the diameter of the axle end previously mentioned. In case of a wheel with four spokes, the cruciform recess in the hub cap may thus be rotated through an angle of 45° with respect to the spokes, and it will thus be appreciated that the shaft is effectively supported in the hub without any risk of the splines of the shaft being received in the spaces between the hub ribs.

Figure 5:
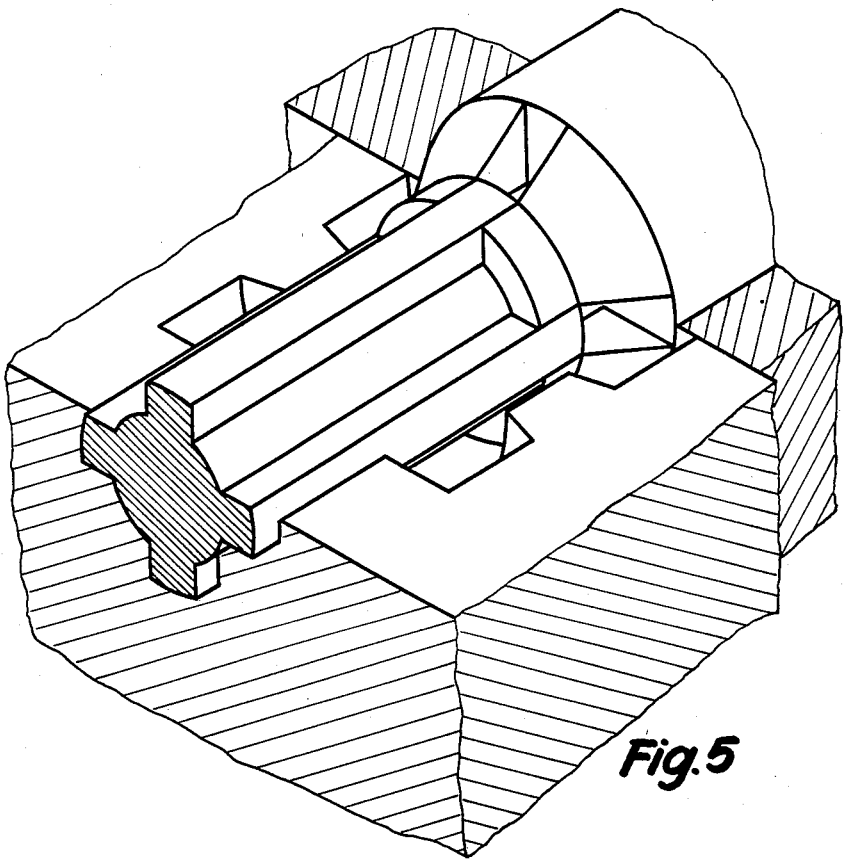
Figure 6:
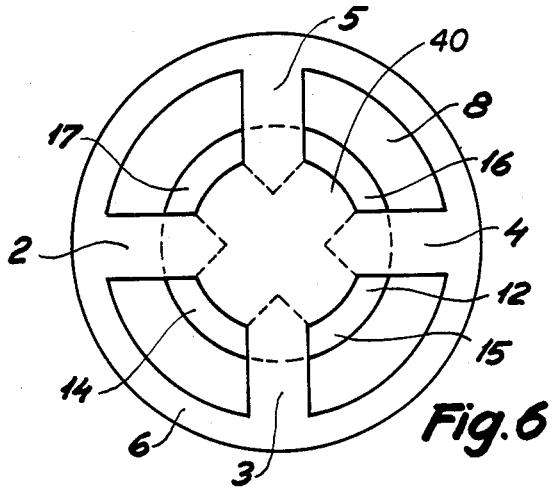
Figure 7:
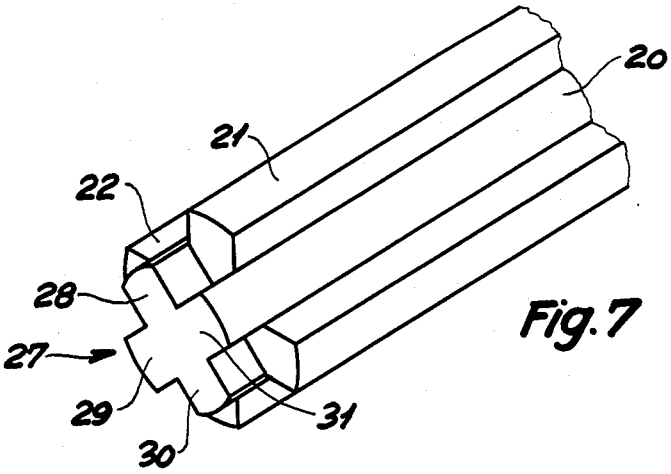

The invention will be explained more fully by the following description of an embodiment with reference to the drawing, in which FIG. 1 shows an embodiment of a wheel according to the invention, seen from the exterior, FIG. 2 shows an axial section through the wheel of FIG. 1 along lines II—II, FIG. 2*a* shows a radial section through the wheel of FIG. 2 along lines IIa—IIa, FIG. 3 shows an axial section through the wheel of FIG. 2 along lines III—III, while FIGS. 4 and 5 show two portions of a tool for making the embodiment shown in FIG. 1, FIG. 6 shows a wheel with an additional recess, while FIG. 7 shows a modification of the tool for providing the additional recess.

The wheel shown in FIG. 1 has on the shown side a hub cap in the form of a circular disc 1 which is continuous with spokes 2–5, which are in turn continuous with a rim 6. The shown wheel is thus intended to allow mounting around the rim of a separate tyre with an internal bead which can be received by a groove 7 in the rim 6. Owing to the authentic appearance the rim has a conical ring-shaped region 8 which together with the hub cap contribute to the authentic shape. The wheel is designed to receive an axle end of the type appearing from FIGS. 2 and 3, where the axle 9 has a slot 10 as well as radially projecting beads 11, 12, which can be squeezed against each other because of the presence of the slot 10 when the axle 9 is to be inserted into the wheel and which can snap back in a region 13 co-axial with the wheel and of greater diameter than the diameter of the axle 9. In particular, the distance measured diametrically across the beads 11, 12 is greater than the bearing face of the wheel hub, which will be explained below.

In the shown embodiment the hub of the wheel consists of four ribs 14–17 disposed somewhat behind the hub cap so that the cavity 13 is defined between the hub cap and the ribs. In FIG. 1 the ribs extend radially between the conical area 8 and form a bearing face 9 for the axle 9, said bearing face being axially aligned with the outer, circular edge of the disc 1. In the preferred embodiment the arc length of the ribs is equal to the arc length between the spokes 2–5. It will thus be appreciated that the beads 11, 12 are visible in FIG. 1 where the slot 10 in the axle 9 is shown by broken lines.

The advantageous features of the wheel of the invention will be understood best in connection with the embodiment of a tool for injection moulding of the wheel, as shown in FIGS. 4 and 5. The tool comprises a mould die 18A, which is cut through, and a pair of other mould dies which are symmetrical around the cutting plane of the mould die 18A, and of which the mould die 18B is visible. The tool moreover comprises two insertion cores 19, 20, of which at least the core 20 is axially movable. The mould dies are also mutually movable longitudinally of the cores. In FIG. 5, the tool is shown in a moulding position, while it is shown in FIG. 4 in a position in which it is most visible. The tool will be explained below, some parts being provided with three-digit reference numerals where the last two digits can be compared with FIGS. 1–3, the corresponding wheel parts being indicated at the three-digit tool part.

It should be possible to avoid trivial explanations of the tool because of this connection between the reference numerals, and only such features will be explained as do not appear readily from the figures. The slots 102–105 are continuous with the diametrically opposite slots to provide the spokes 2–5, the slots being interconnected through a circular base whose diameter is equal to the internal distance between the projections 113. When the tool is in the moulding position, the end of the core 20 is spaced from the said base at a distance equal to the thickness of the hub cap disc 1. It will thus be appreciated that the moulding material can flow through the cavities 102–105 and collect to provide the disc 1. As appears from FIG. 4, the core 20 has four ribs, the ribs 21–23 being visible, which fit snugly in the spaces between the projections 113 as appears from FIG. 5. The projections 113 and the ends of the ribs on the core 20 thus define the annular cavity 13, while the ribs on the core define the spaces between the ribs 14–17.

In the preferred embodiment the ribs 21–23 on the core 20 have a uniform cross-section, but it will be appreciated that the arc distance between the portion of the ribs disposed outside the projection 113 in the moulding position, might be smaller than shown, without this causing problems when the tool is to be removed from the casting. In this case, the hub cap (i.e. 1 and the spokes 2–5) would cause axial overlapping of just a fraction of the cavity defined between the ribs 14–17 (this overlap is only considered within a region co-axial with the hub cap and of greater diameter than the bearing face diameter but of smaller diameter than another predetermined one, such as the smallest diameter of the conical region 8).

If the arc distance between the ribs 20 of the core was greater than the arc length of the projections 113, the core 20 could not be withdrawn from the casting, it being borne in mind that the outermost end of the ribs 21–23 disposed between the projections 113 is to fill the spaces between the last-mentioned projections completely in order to obtain the annular cavity 13 to receive the beads 11, 12 of the axle. It will likewise be appreciated that the diameter of the hub cap disc 1 cannot be greater than the core diameter of the core 20 as, otherwise, the casting cannot release the core 19.

The structure of the wheel as defined in the characterizing portion of claim 1 is thus the necessary and sufficient condition of the provision of a functional tool which is the pre-requisite for mass-production of the wheel.

In FIG. 6 the wheel from FIG. 1 is shown with the exception that the hub cap is formed with an additional recess to receive a cruciform axle instead of the axle 9 previously described. In the embodiment described in the foregoing the wheel rotates freely on the axle end, but uses are conceivable where a positive engagement between an axle and the wheel is desired, which is also feasible according to the invention under the conditions stated in the characterizing portion of claim 1.

More particularly, the hub cap in FIG. 6 may have a cruciform recess 40 which is shown in broken lines and corresponds in cross-section to a cruciform shaft whose greatest diameter corresponds to the diameter of the axle end 9 from FIGS. 2 and 3. As the recess in the hub cap is rotated through about 45° with respect to the spokes 2–5, the splines of the cruciform shaft will be supported in the hub by the ribs 14–17, and there is thus no risk of shaft splines being received in the space between the ribs 14–17. The recess in the hub cap is only open in a direction toward the hub to ensure coherence in the material.

The recess mentioned in connection with FIG. 6 can be provided by a modification of the previously described tool, as appears from FIG. 7. FIG. 7 shows one end of the insertion core 20' which faces in a direction toward the insertion core 19 in FIG. 4. A cruciform projection 27 is provided in axial elongation of the previous embodiment, comprising four splines 28–31 which, with respect to the ends of the splines 21', 22' extend forwardly a distance which is smaller than the thickness of the hub cap. The projection 27 is received by the core 19 from FIG. 4 in the cavity which is defined between the jaws 108, but does not extend right to the bottom of the cavity, in order that the material may merge. It will be appreciated that a longer projection 27 can be matched by an additional depression in the core 19 so that the hub cap will be thicker, enabling provision of a deeper recess to receive the cruciform shaft.

We claim:

1. A wheel, in particular for a toy building set, and with a hub comprising an outer cylindrical rim portion (6) and a plurality of axial ribs (14, 17) which extend radially inwardly from the hub ending in arcuate surfaces for supporting an axle and a hub cap (1–5) which is integrally connected to the wheel at an axial distance from the ribs (14–17) and which nowhere overlaps an axial elongation of the ribs within a region co-axial with the axis and of greater diameter than the support surface diameter.

2. A wheel according to claim 1, characterized in that the hub cap (1–5) is axially aligned with a cavity which is defined within and between the ribs (14–17).

3. A wheel according to claim 1 or 2, characterized in that the region (13) is ring-shaped to receive an annular bead (11) at the end of a wheel axle (9).

4. A wheel according to claim 1, characterized in that the hub cap has a recess 40 which is open in a direction toward the hub and is designed to receive a splined axle, said wheel further comprising a plurality of projections disposed between the splines in alignment with the hub ribs.

5. A wheel according to claim 1 wherein the hub comprises a plurality of spokes axially aligned with said ribs.

* * * * *